United States Patent [19]

Bernhardson

[11] 4,165,888

[45] Aug. 28, 1979

[54] CROSS COUNTRY SKI BINDING

[76] Inventor: Gary E. Bernhardson, 3224 Pleasant Dr., Anchorage, Ak. 99502

[21] Appl. No.: 848,868

[22] Filed: Nov. 7, 1977

[51] Int. Cl.[2] ..... A63C 9/20

[52] U.S. Cl. ..... 280/615; 280/635

[58] Field of Search ..... 280/615, 635, 614

[56] References Cited

U.S. PATENT DOCUMENTS

| | | | |
|---|---|---|---|
| 3,481,618 | 12/1969 | With | 280/615 |
| 3,905,612 | 9/1975 | Kjellstrom | 280/615 |

FOREIGN PATENT DOCUMENTS

| | | | |
|---|---|---|---|
| 2127935 | 12/1976 | Fed. Rep. of Germany | 280/615 |
| 68636 | 11/1944 | Norway | 280/615 |
| 57801 | 4/1922 | Sweden | 280/615 |

*Primary Examiner*—Joseph F. Peters, Jr.
*Assistant Examiner*—Gene A. Church
*Attorney, Agent, or Firm*—Merchant, Gould, Smith, Edell, Welter & Schmidt

[57] ABSTRACT

A cross country ski binding is disclosed wherein the boot-engaging toe iron is hingeably attached to a plate permanently affixed to the cross country ski. A single member provides the means for both clamping the cross country ski boot to the toe iron and hingeably attaching the toe iron to the anchored binding plate.

13 Claims, 11 Drawing Figures

CROSS COUNTRY SKI BINDING

BACKGROUND OF THE INVENTION

1. Field of the Invention

This invention relates generally to the field of ski bindings and more particularly concerns the field of cross country ski bindings of the toe binding type.

2. Description of the Prior Art

Typically, cross country ski bindings of the toe binding type comprise a toe iron anchored to the ski, in which a resilient clamping member generally constructed of sturdy wire is mounted. When the toe of a cross country ski boot is placed in the toe iron, an extending portion of the boot sole is slipped under the clamping wire. The typical toe binding also includes means for pressing the clamping wire down on the extending sole portion and holding the clamping wire down on the boot sole. Such typical cross country ski bindings are disclosed in the patent to With, U.S. Pat. No. 3,481,618, and the patent to Kjellstrom, U.S. Pat. No. 3,905,612.

The motion utilized in cross country skiing or ski touring requires that the heel of the cross country ski boot be lifted regularly from the ski. The typical cross country toe binding, of which the With and Kjellstrom bindings are representative, make no provision for this heel lifting action, relying instead upon the flexibility and resiliency of the boot sole to effect such action. Such a system presents several problems. For example, the constant upward pressure exerted by the boot sole against the downward pressure of the clamping wire, in combination with the constant flexing of the boot sole as the heel is lifted, tends to loosen the boot sole in the toe binding. Also, great stress is placed on the boot sole by its constant flexing, which impairs its useful life. Finally, and most importantly, the flexibility of the boot sole with such bindings is necessarily limited, which impairs the ability of the skier to perform serveral maneuvers which may be required of him.

Several cross country toe bindings have recognized these problems, and have provided a hinging action at the toe piece. Two such bindings are disclosed in West German Pat. No. 2,333,042, issued Apr. 4, 1974, and West German Pat. No. 2,127,935, issued Dec. 16, 1971.

The toe bindings providing for hinging movement relative to the ski, which have been heretofore known, have left several problems unsolved. For instance, such toe bindings have commonly contained separate hinging mechanisms, clamping bars, and means for holding the clamping bars secure on the boot sole. With such a number of parts, the bindings present the problem of higher costs to manufacture. Furthermore, the heretofore known hinging toe bindings have been constructed so that the upward pressure exerted against the clamping bar by the boot sole has tended to move the clamping bar in such a way as to release it from the holding means clamping it down on the boot sole.

SUMMARY OF THE INVENTION

In accordance with the present invention, a cross country ski binding of the toe binding type is provided in which a first binding plate is anchored to the ski and a second binding plate, or toe iron including a sole plate for engaging the lower surface of a boot sole is adapted for hingeable movement relative to the first binding plate. A single member defines both the clamping bar for engaging the upper portion of the boot sole extension, and the hinge pins by means of which the toe iron is hingeably attached to the anchored binding plate. This three piece construction provides for simple and inexpensive manufacture, and a light weight binding piece.

The means for fixing the clamping bar against rotation with respect to the hinged toe iron comprise a resilient clamp handle extending upwardly from the clamping/hinging member, and a hook fashioned from the body of the toe iron itself, which is engageable with the clamp handle. The hook is so oriented that the resilient clamp handle must be urged towards the boot toe in order to disengage it from the hook, thus having the advantage that the upward and forward motion of the boot toe during skiing serves to urge the clamp handle further into engagement with the hook, rather than out of engagement therewith, thus avoiding the possibility of inadvertent release of the clamping means while skiing.

DESCRIPTION OF THE PREFERRED EMBODIMENT

Figure 1:
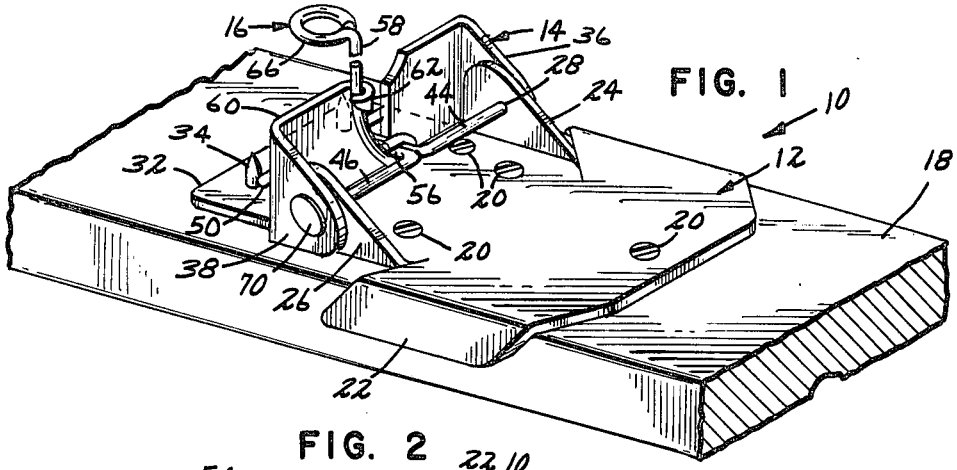
FIG. 1 is a view in perspective showing a portion of a cross country ski and the toe binding of the present invention.

Turning first to FIG. 1, there is shown a cross country ski binding 10 constructed in accordance with the present invention. Binding 10 is comprised of three main elements: a first binding plate 12, a toe iron 14, and a combination hinging/clamping member 16.

Binding plate 12 and toe iron 14 are stamped from a sheet of 3/32 inch thick aluminum, and bent to the forms shown in the drawings. Hinging/clamping member 16 is constructed of resilient wire.

Binding plate 12 is mounted on cross country ski 18 by means of a plurality of anchoring screws 20. Two wings 22 on binding plate 12 are folded over the top edge of ski 18 so as to engage the side walls of ski 18. Binding plate 12 also carries opposed upstanding members 24 and 26 with aligned holes 28 and 30 therein defining bearings.

Toe iron 14 includes a sole plate 32 having holes into which a plurality of upwardly extending studs 34 are pressed. Toe iron 14 further includes a pair of forwardly extending opposed members 36 and 38 having aligned holes 40 and 42 therein defining bearings. Holes 40 and 42 are aligned with holes 28 and 30.

Figure 2:
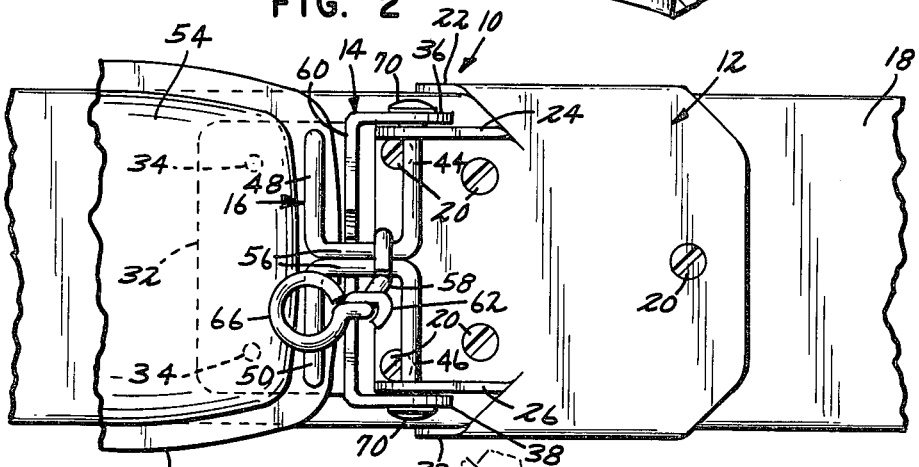
FIG. 2 is a top plan view of the present invention mounted on a cross country ski, and showing the toe and extending sole portion of a cross country ski boot engaged with the toe iron of the present invention.
Figure 3:
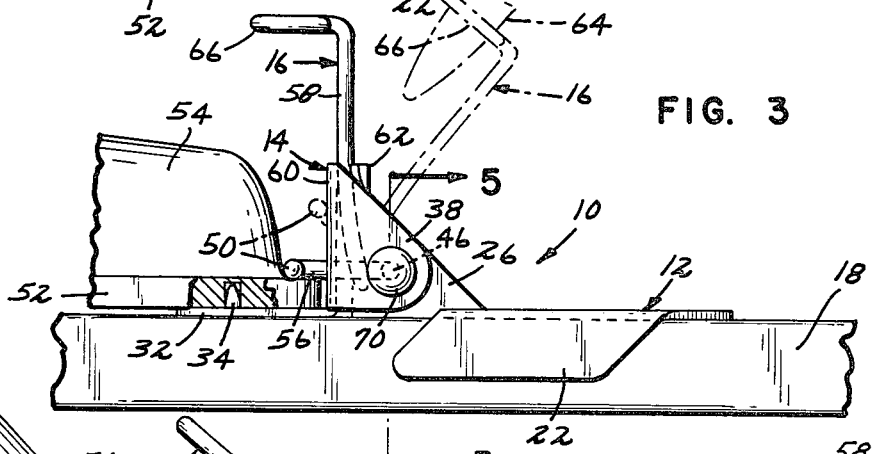
FIG. 3 is a view in side elevation showing a cross country ski boot engaged with the toe binding of the present invention and indicating the disengaged position of the clamping member.
Figure 8:
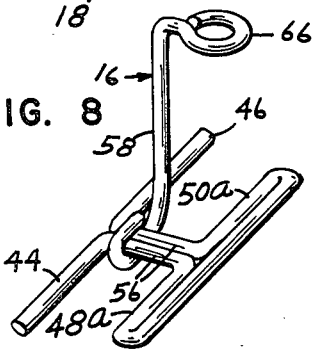
FIG. 8 is a view in perspective showing an alternative form of a hinging/clamping member.

Hinging/clamping member 16 may be constructed of two U-shaped pieces of wire affixed to each other base to base by any appropriate means, as is most clearly shown in FIG. 2, or may be constructed from a single piece of wire appropriately bent, as is illustrated in FIG. 8. The resulting structure is generally H-shaped, with one set of arms 44 and 46 defining hinge pins which are journalled in the appropriate aligned bearing holes defined by members 24, 26, 36, and 38. The remaining two arms, 48 and 50, define a clamping bar, which is engageable with an upper surface of the extending sole portion 52 of cross country ski boot 54, as shown in FIGS. 2 and 3. The hinge pin arms and the clamping bar arms of hinging/clamping member 16 are connected by a cross member 56. Extending upwardly from cross member 56 is a clamp handle 58. Clamp handle 58 is constructed of a resilient material, and extends upwardly from cross member 56 so as to be spring-biased towards the center line of cross member 56, as defined by the adjoining bases of the U-shaped members.

Figure 4:
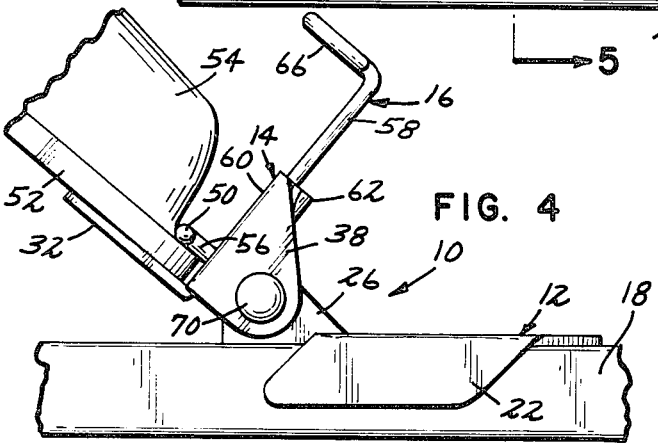
FIG. 4 is a view in side elevation showing the hinging action of the toe iron in relation to the anchored binding plate when a cross country ski boot is clamped to the toe iron.
Figure 6:
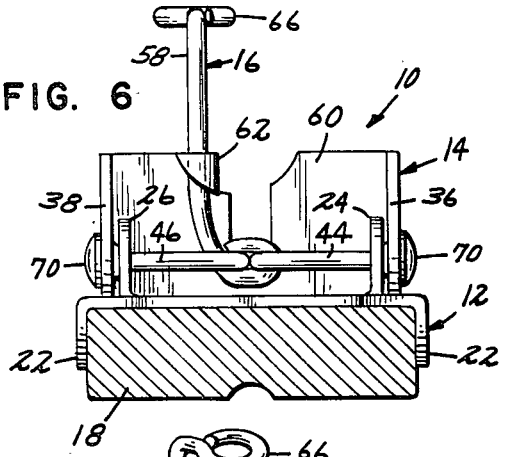
FIG. 6 is a view in end elevation looking from the anchored binding plate towards the toe iron of the toe binding.
Figure 7:
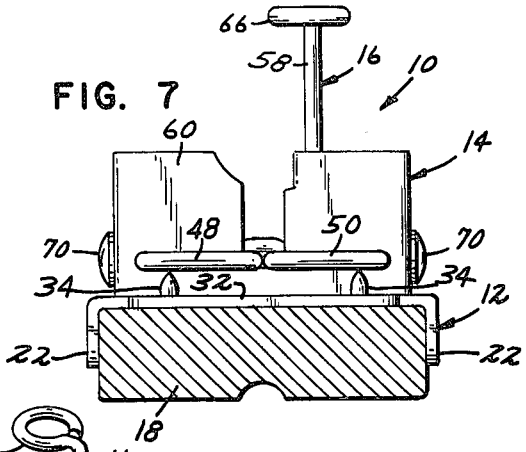
FIG. 7 is a view in end elevation looking from the toe iron towards the anchored binding plate of the toe binding of the present invention.

Toe iron 14 includes a toe plate 6 having a portion thereof cut away and curled towards the forward portion of ski 18, as shown in FIGS. 1, 6 and 7, so as to form a hook 62 which is engageable with clamp handle 58. When clamp handle 58 is engaged with hook 62, hinging/clamping member 16 is fixed against rotation with respect to toe iron 14, although it is free to pivot with respect to binding plate 12. Thus, when clamping bar arms 48 and 50 engage boot sole 52, boot 54 is clamped in toe iron 14, which is free to pivot upwardly around hinge pins 44 and 46, as shown in FIG. 4. To further aid in engaging boot 54 with toe iron 14, studs 34 engage pre-drilled holes in boot sole 52, as shown in FIG. 3.

Boot 54 may be unclamped from toe iron 14 by disengaging clamping handle 58 from hook 62 by a slight deflection of clamp handle 58. This deflection action may be aided by placing the tip of a ski pole 64 in a receptable ring 66 provided at the top of clamp handle 58, as is also shown in FIG. 3.

Figure 9:
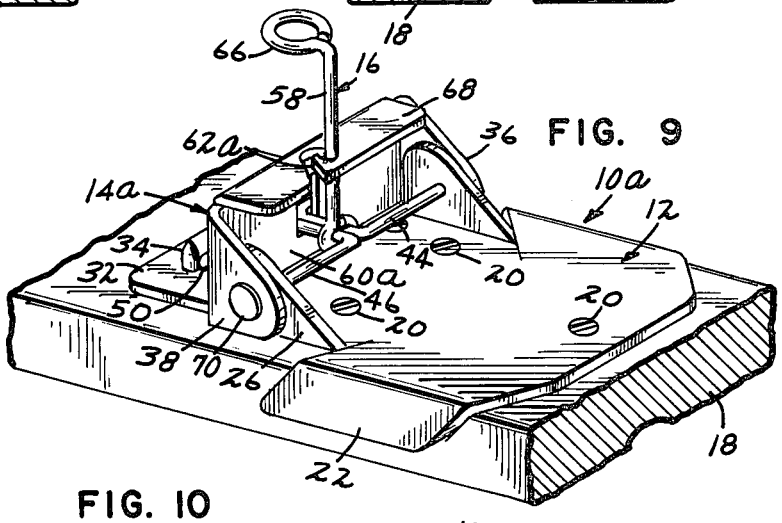
FIG. 9 is a view similar to that shown in FIG. 1, showing an alternative hook arrangement.
Figure 10:
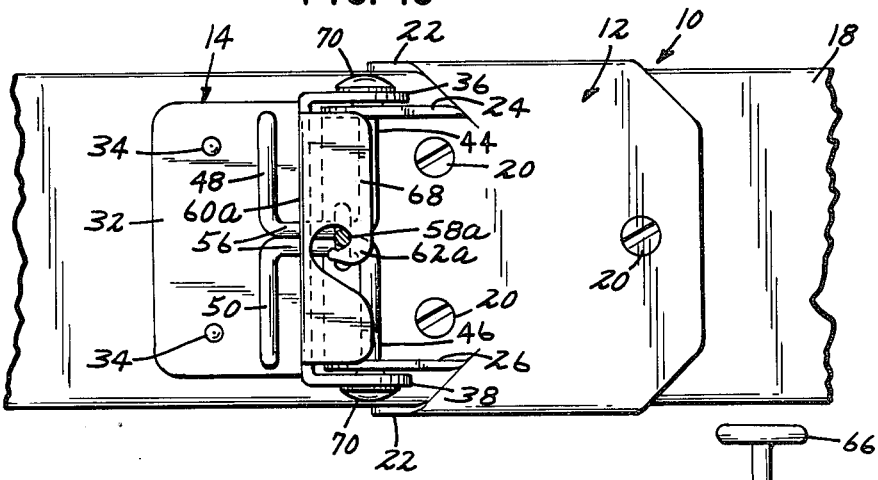
FIG. 10 is a top plan view of the embodiment shown in FIG. 9, portions thereof being broken away and shown in section.
Figure 11:
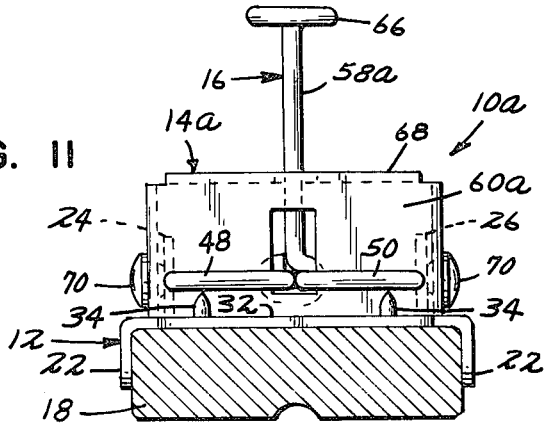
FIG. 11 is a view similar to that shown in FIG. 7 of the embodiment shown in FIGS. 9 and 10.

An alternative design for hook 62 is illustrated in FIGS. 9, 10 and 11, in which like numerals represent identical structure, and reference numerals for modified structure also bear the letter a. In this embodiment, toe plate 60*a* of toe iron 14*a* includes a forwardly extending top portion 68, from which a curved portion has been cut to form the hook 62*a*. When this hook design is utilized, a clamp handle 58*a* extending perpendicularly upwardly from cross member 56 is used. This configuration is best shown in FIGS. 9 and 11.

With either hook 62 or 62*a*, it will be appreciated that any upward and forward pressure exerted on the clamping arms 48 and 50 by boot sole 52 will serve to urge clamp handle 58 into engagement with the hook rather than out of engagement therewith, thus avoiding any inadvertent release.

Figure 5:
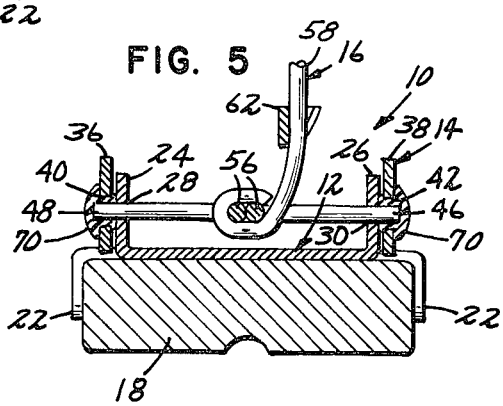
FIG. 5 is a sectional view taken along the line 5—5 of FIG. 3.

To complete the structure of binding 10, hinge pin arms 44 and 46, when journalled in the appropriate bearing holes, are capped with bearing caps 70, which include portions extending through members 34 and 36 of toe iron 14, as is best shown in FIG. 5. It may also be desirable to place nylon washers on hinge pin arms 44 and 46 between the bearing defining members of binding plate 12 and toe iron 14, although this is not required.

It will be appreciated from the foregoing, that an improved, hingeable cross country ski binding of the toe binding type has been invented, which may be constructed of light weight, easy-to-manufacture components.

What is claimed is:

1. A cross country ski binding of the toe binding type for use in attaching a cross country ski boot having a projecting sole portion at the toe end of the boot to a cross country ski, said binding comprising:
   (a) a first binding plate and means for fixing said first binding plate to a ski, said first binding plate having a pair of first opposed members;
   (b) a toe iron including a sole plate for engaging a lower surface of the projecting sole portion of a cross country ski boot and a pair of second opposed members;
   (c) each of said first and second opposed members a defining bearing means and said bearing means being aligned;
   (d) combination clamping and hinging means hingeably attaching the first binding plate with the toe iron to permit upward and downward rotation of the toe iron with respect to the first plate, and for clamping a boot engaging said sole plate to the toe iron, said combination clamping and hinging means including means defining a hinge pin having opposite end portions journalled in the opposed aligned bearing means.

2. The cross country ski binding of claim 1 wherein the combination clamping and hinging means includes means for engaging an upper surface of the projecting sole portion of the sole of a boot engaging the sole plate.

3. The cross country ski binding of claim 2 which further includes means for fixing said upper sole surface engaging means against rotation with respect to the sole plate.

4. The cross country ski binding of claim 3 wherein the combination clamping and hinging means further includes means defining a cross bar extending between the hinge pin and the upper surface engaging means, and means fixed on said cross bar defining a clamp handle.

5. The cross country ski binding of claim 4 wherein the rotation fixing means includes means carried on said toe iron for releasably engaging the clamp handle.

6. The cross country ski binding of claim 5 wherein the toe iron further comprises a plurality of upwardly projecting studs engageable with a plurality of receptable holes in the sole of the cross country ski boot.

7. A cross country ski binding for releasably attaching a cross country ski boot to a cross country ski, wherein the cross country ski boot includes a sole portion extending beyond the toe of the shoe, said binding comprising:
   (a) a pair of upstanding members defining opposed first bearings and means for fixing said members on a ski;
   (b) a toe iron including a pair of upstanding members defining second opposed bearings aligned with said first opposed bearings, said toe iron further including a sole plate engageable with a lower surface of the extending sole portion of a cross country ski boot;

(c) a hinging and clamping member including a first pair of colinear legs defining a hinge pin, each of said legs having an end portion journalled in one of said first and one of said second aligned bearings, whereby the hinging and clamping member is free to rotate with respect to the fixed members and the toe iron, said hinging and clamping member also including means engageable with an upper surface of the extending portion of the cross country ski boot sole which is engaged with said sole plate; and (d) means for securing said hinging and clamping member against rotation with respect to the toe iron when the upper surface engaging means is in engagement with a cross country ski boot sole extension portion.

8. The cross country ski binding of claim 7 wherein the upper sole surface engaging means of the hinging and clamping member comprises a second pair of colinear legs attached to said first pair of colinear legs by at least one cross member, said second pair of colinear legs defining a toe bar.

9. The cross country ski binding of claim 8 wherein the hinging and clamping member securing means comprises a clamp handle extending upwardly from said hinging and clamping means, and means on said toe iron for releasably holding said clamp handle when said toe bar is engaged with a cross country boot sole.

10. The cross country ski binding of claim 9 wherein said clamp handle holding means comprises a portion of said toe iron which defines a hook.

11. The cross country ski binding of claim 10 wherein the clamp handle is resilient, whereby it is engageable and disengageable with said hook by effecting slight deflections thereof, and wherein the clamp handle further comprises a ski pole tip engaging portion, whereby said deflections may be effectuated by means of a ski pole engaging said portion.

12. The cross country ski binding of claim 11 wherein the toe iron further includes a plurality of upwardly projecting studs on the sole plate corresponding to a plurality of receptacle holes in the sole of the cross country ski boot.

13. A cross country ski binding comprising, in combination:

(a) a binding plate including means defining a pair of opposed bearings;

(b) a toe iron including a sole plate and a toe plate having a first side facing the toe of a boot engaged with said sole plate and a second side opposite said first side, said second side having hooking means extending therefrom; and (c) a hinging/clamping member including means defining a hinge pin having opposed ends journalled in said opposed bearings of the binding plate and the toe iron, said member further including means defining a clamping bar engageable with an upper surface of a boot engaging the sole plate, said hinge pin and clamping bar extending generally parallel to each other and to the toe plate, said toe plate being interposed between the clamping bar and the hinge pin, said hinging/clamping member further including a handle member releasably engageable with said hooking means whereby the toe iron is rotatable with respect to the binding plate, the clamping bar is fixed against rotation with the iron when the handle member is engaged with the hooking means, and upward and forward forces exerted on the clamping bar urge the handle member further into engagement with the hooking means.

* * * * *

UNITED STATES PATENT AND TRADEMARK OFFICE

CERTIFICATE OF CORRECTION

PATENT NO. : 4,165,888
DATED : August 28, 1979
INVENTOR(S) : Gary E. Bernhardson It is certified that error appears in the above-identified patent and that said Letters Patent are hereby corrected as shown below:

Column 3, line 32, use of the words "toe plate 6" should be changed to --toe plate 60--.

Signed and Sealed this

*Eleventh* Day of *December 1979*

[SEAL]

*Attest:*

SIDNEY A. DIAMOND

*Attesting Officer*

*Commissioner of Patents and Trademarks*